US006641491B1

(12) United States Patent
Schillaci

(10) Patent No.: US 6,641,491 B1
(45) Date of Patent: Nov. 4, 2003

(54) GOLF SAND WEDGE HEAD

(76) Inventor: Pippo G. Schillaci, 1135 Makawao Ave., 103-287, Makawao, Maui, HI (US) 96768

( * ) Notice: Subject to any disclaimer, the term of this patent is extended or adjusted under 35 U.S.C. 154(b) by 0 days.

(21) Appl. No.: 10/137,013

(22) Filed: May 1, 2002

(51) Int. Cl.[7] ..... A63B 53/04
(52) U.S. Cl. ..... 473/349; 473/350
(58) Field of Search ..... 473/324, 349, 473/350, 314, 328, 290, 291, 292, 287; D21/747, 748, 749, 759

(56) References Cited

U.S. PATENT DOCUMENTS 3,814,437 A * 6/1974 Winquist
4,826,172 A * 5/1989 Antonious
4,938,470 A * 7/1990 Antonious
5,014,993 A * 5/1991 Antonious
5,074,563 A * 12/1991 Gorman
5,328,184 A * 7/1994 Antonious
5,401,021 A * 3/1995 Allen
5,447,307 A * 9/1995 Antonious
5,547,194 A * 8/1996 Aizawa
5,669,826 A * 9/1997 Chang
5,842,934 A * 12/1998 Ezaki
5,971,868 A * 10/1999 Kosmatka
6,015,354 A * 1/2000 Ahn

* cited by examiner

*Primary Examiner*—Sebastiano Passaniti
(74) *Attorney, Agent, or Firm*—Jack C. Munro

(57) ABSTRACT

A golf sand wedge head which has a front planar face and a rear surface which is formed to include a plurality of precisely defined relief areas. The front face extends from a top edge to a bottom edge with the bottom edge connecting with a planar bottom surface which is located at about a sixty degree angle relative to the planar front face. The bottom edge is offset approximately 0.19 inches from a longitudinal center axis of the hosel of the sand wedge head.

12 Claims, 2 Drawing Sheets

GOLF SAND WEDGE HEAD

BACKGROUND OF THE INVENTION

1. Field of the Invention

The field of this invention relates to sporting goods and more particularly to a new and novel configuration of a golf sand wedge.

2. Description of the Related Art

In golf, there is utilized a plurality of different clubs. Typically, the clubs include a plurality of "woods" and a plurality of "irons". Each "iron" has a different number and has a different inclined face. The most vertical the faced club is the lowest number "iron" which would be a one "iron", and the most inclined face would be in a wedge which would have the highest number which is usually number ten. However, currently in golf there is not utilized just a single wedge but most players play with a plurality of different wedges. There is a pitching wedge which is designed to propel the ball between one-hundred and one-hundred forty yards. There is a sand wedge which is designed to propel the ball eighty to ninety yards when the sand wedge is used with a full swing with the golf ball located on the fairway (short grass). There is also available a sixty-degree wedge which is designed for shorter distances, such as up to about seventy yards.

It has been more than seventy years since Gene Sarazen modified a pitching wedge and produced the sand wedge that is played today. Mr. Sarazen added loft, weight and bounce to a pitching wedge which resulted in the production of the sand wedge. Over the last seventy years, most golf clubs have gone through dramatic changes that provide improved strike-ability, distance and direction. However, prior to the present invention, the sand wedge has gone through very little modification.

The sand wedge continues to perform as it always has for the last seventy years. It is the club that is used for the toughest shot, that is to remove a ball from a sand bunker, and it is the shot that adds the most strokes to a golf game. Many things have been tried to enhance the performance of sand wedges including perimeter weighting. Perimeter weighting is great for the rest of the irons within ones golf bag, but it tends to impede the performance of a sand wedge. The only reason it can be seen for a sand wedge to have perimeter weighting is so that the sand wedge would look in appearance like the rest of the clubs.

All sand wedges that are currently in use, prior to the present invention, have the weighting of the head of the club front loaded which creates a large frontal area at the sole of the front face of the club. This front loaded weighting gives the player a feeling of pushing and forcing the ball through the sand. This is not the desirable feeling that one should have when swinging of a sand wedge within a sand bunker. The golfer should have the feeling of pulling the shot through the sand rather than pushing it. For a golfer to even hope to master the operation of a prior art sand wedge, it takes a special hand-eye coordination and dedication to long hours of practice. Generally, only professionals possess the necessary attributes to be somewhat successful at flying a golf ball out of a sand bunker. However, even professionals have a very difficult time coming out of a sand bunker close to the golf hole so that it makes the next shot the final shot for that hole. More often than not, even pro golfers frequently at least two putt after coming out of a sand bunker.

SUMMARY OF THE INVENTION

The golf sand wedge head of the present invention has been designed for easy penetration of the head into the sand as the club is being swung. Also, the shaft of the club has been offset so that the longitudinal center axis of the shaft of the club is located ahead of the sole of the club. The weight has been redistributed of the face of the club to create the easy entry profile into the sand and achieve a superior feeling when making of the shot. The offset shaft together with the weight moved rearward places the sweet spot spaced from the sole and from the hosel within the center of the head of the club. The offset creates a slight delay in the arrival of the head and the feeling of pulling the shot rather than pushing it and transmits an intense sensation to the golfer of the proper swing. This feeling that is transmitted to the golfer makes the sand shot in golf much easier.

A basic embodiment of the present invention utilizes a golf sand wedge head which has a hosel adapted to be fixedly mounted to a golf club shaft. The hosel has a longitudinal center axis. The hosel is fixedly connected to a body. This body has a front face for striking a golf ball in the central section of the front face and a rear face which is opposite the front face. The front face has a toe edge located furthest from the hosel and a top edge located furthest from the bottom edge of the sole of the club. The sole of the club comprises a planar bottom surface which extends to the rear face of the body. The planar bottom surface is located at a first acute angle relative to the front face and the bottom edge is offset a certain distance from the longitudinal center axis of the hosel. The front face is inclined also at an acute angle relative to the longitudinal center axis of the hosel. The rear face includes relief areas. The relief areas combine to produce a ridge which extends vertically from the bottom edge toward the top edge which weights the body so as to produce a "sweet spot" located within the central section of the front face.

A further embodiment of the present invention is where the basic embodiment is modified by the front face being planar.

A further embodiment of the present invention is where the first basic embodiment is modified by the acute angle of the bottom surface to the front face being at approximately sixty degrees.

A further embodiment of the present invention is where the first basic embodiment is modified by the offset being approximately 0.19 inches.

A further embodiment of the present invention is where the first basic embodiment is modified by the acute angle of the front face being at approximately fifty-seven degrees.

A further embodiment of the present invention is where the first basic embodiment is modified by the relief areas being defined as a first relief area, a second relief area and a third relief area with the first relief area being deepest.

A further embodiment of the present invention is where the first basic embodiment is modified by the second relief area being shallowest.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
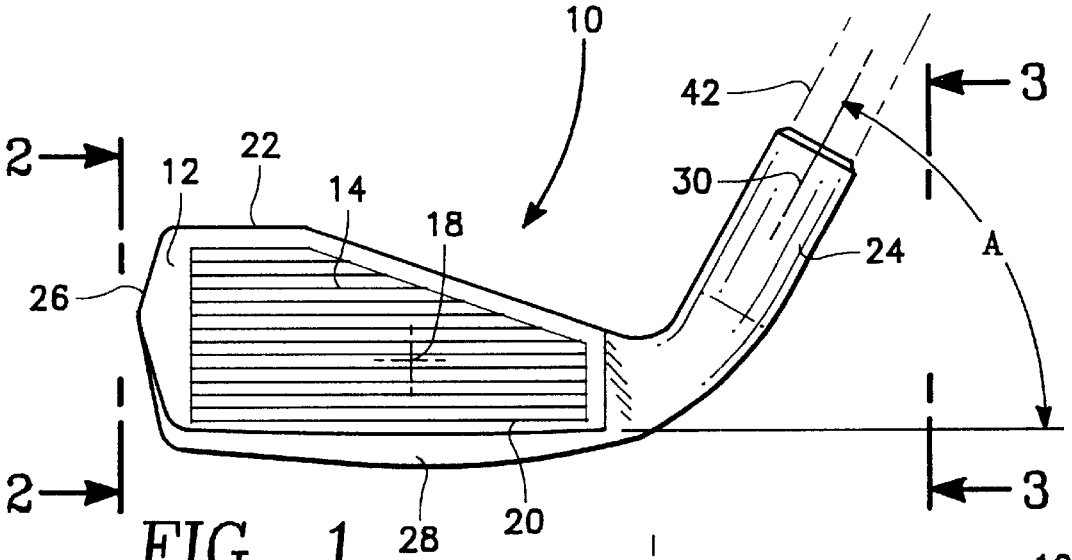
FIG. 1 is a front view of the golf sand wedge head of the present invention showing the front face of the club at an inclined angle which would be the typical angle of the club face when striking of a golf ball.

Referring particularly to the drawings, there is shown the golf sand wedge head 10 of this invention. The head 10 has a planar front face 12 which includes a mass of parallel closely spaced apart grooves 14. The grooves 14 are deemed to be conventional and form no specific part of this invention. It is the function of the grooves 14 to impart spin onto the ball when the ball is struck on the front face 12. It is intended to have the ball strike within central section 16 of the front face 12. This central section 16 has a center of gravity point which is commonly referred to as a "sweet spot" 18. If the ball is struck within the central section 16 and right on the "sweet spot", then the ball will generally have the best trajectory and travel the distance that is desired for the particular shot. The front face 12 has a bottom edge 20 which is located at the sole of the club. Located furthest from the bottom edge 20 is a top edge 22. The front face 12 at its inner edge connects to a hosel 24. Located furthest from the hosel 24 is a toe edge 26.

The bottom edge 20 connects with a planar bottom surface 28. The planar bottom surface 28 may not be precisely flat but it could have a slight curve to it. However, for purposes of this invention, it will be referred to as a planar bottom surface. The planar bottom surface 28 is preferably formed at about a sixty degree angle relative to the front face 12 which is called a first acute angle. However, it is considered to be within the scope of this invention that this angular relationship could be varied to be anywhere between fifty degrees and seventy degrees.

The hosel 24 has a longitudinal center axis 30. The distance of the bottom edge 20 from the longitudinal center axis 30 is preferably about 0.19 inches. This displacing of the front of the bottom edge 20 from the longitudinal center axis 30 is to be referred to as an offset. The amount of this offset could be increased or decreased without departing from the scope of this invention. The offset could be as little as one-tenth of an inch or could be as great as three-tenths of an inch. However, it is preferable that 0.19 inches is the preferable amount of offset.

The planar bottom surface 28 connects with the rear face 32 of the body of the sand wedge head 10. Formed within the rear face 32 is a series of relief areas which is defined as the first relief area 34, a second relief area 36 and a third relief area 38. The first relief area 34 is located closest to the hosel 24. The second relief area 36 is located closest to the toe edge 26. The third relief area 38 is located closest to the top edge 22. The arrangement of the relief areas 34, 36 and 38 is such that there is formed a ridge 40. The ridge 40 is vertically oriented and extends from substantially directly adjacent the planar bottom surface 28 toward the top edge 22 but stops at the third relief area 38. The purpose of the ridge 40 is to concentrate the weight of the head 10 at around the transverse middle of the club which when combined with the shallowness of the second relief area 36 will result in the center of gravity being moved away from the hosel 24 toward the toe edge and will actually be located at the "sweet spot" 18. It is desirable to have the "sweet spot" being located substantially in the center of the front face 12. The third relief area 38 extends across both said first relief area 34 and said second relief area 36 so the length of said third relief area 38 being almost equal to the combined length of relief areas 34, 36 minus the width of the ridge 40.

It is also to be noted that the third relief area 38 is somewhat deep though not as deep as the first relief area 34. This results in the lowering of the overall weight of the head 10 to again locate the center of gravity or the "sweet spot" 18 at approximately midway between the bottom edge 20 and the top edge 22. This location is again the preferable location for the striking of the golf ball.

Figure 2:
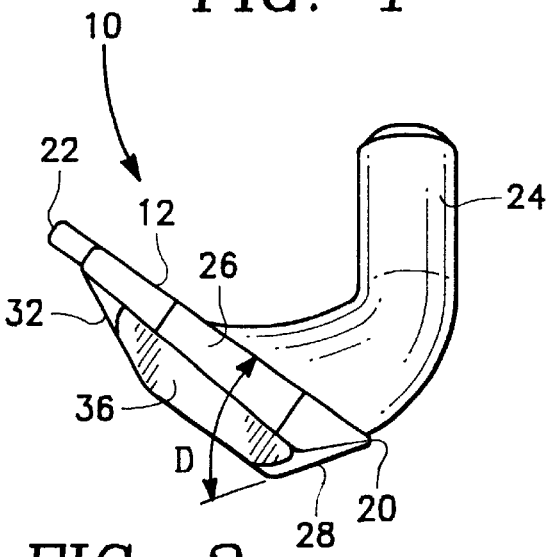
FIG. 2 is an end view at the toe of the golf sand wedge head of the present invention taken along line 2—2 of FIG. 1.
Figure 3:
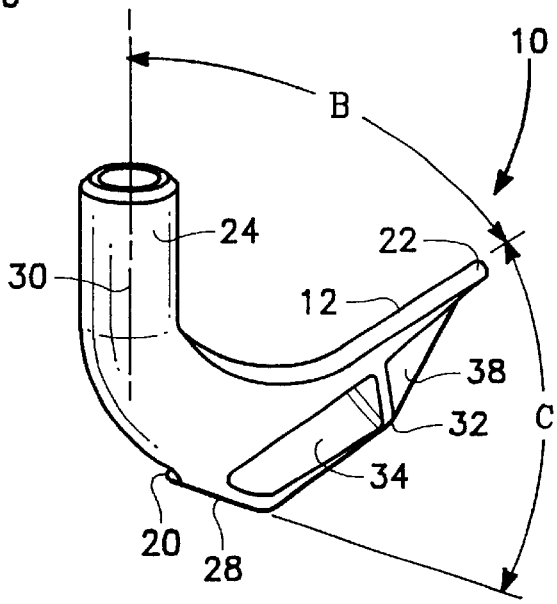
FIG. 3 is an end elevational view of the golf sand wedge head of the present invention taken along line 3—3 of FIG. 1.
Figure 4:
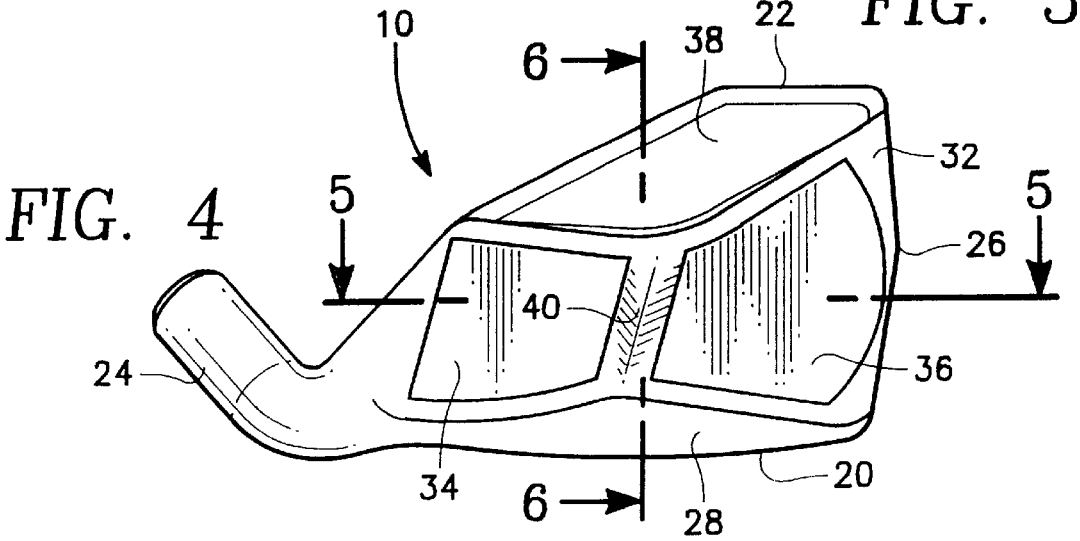
FIG. 4 is a back view of the golf sand wedge head of the present invention.
Figure 5:
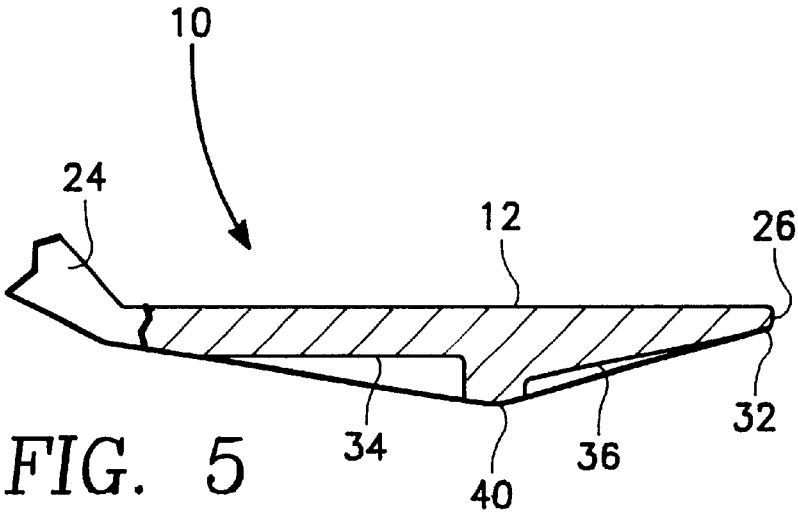
FIG. 5 is a horizontal cross-sectional view through the golf sand wedge head of the present invention taken along line 5—5 of FIG. 4.
Figure 6:
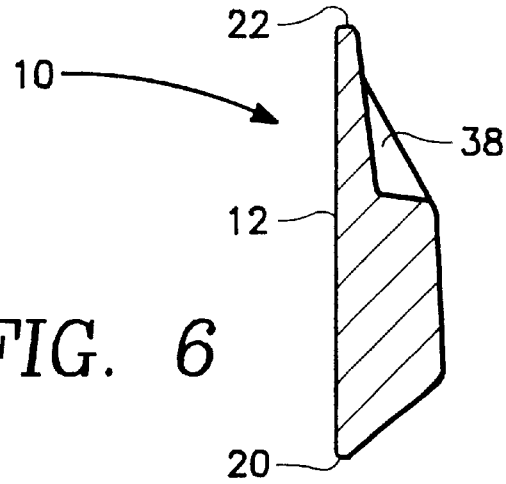
FIG. 6 is a vertical cross-sectional view taken along line 6—6 of the golf sand wedge head of the present invention.
Figure 7:
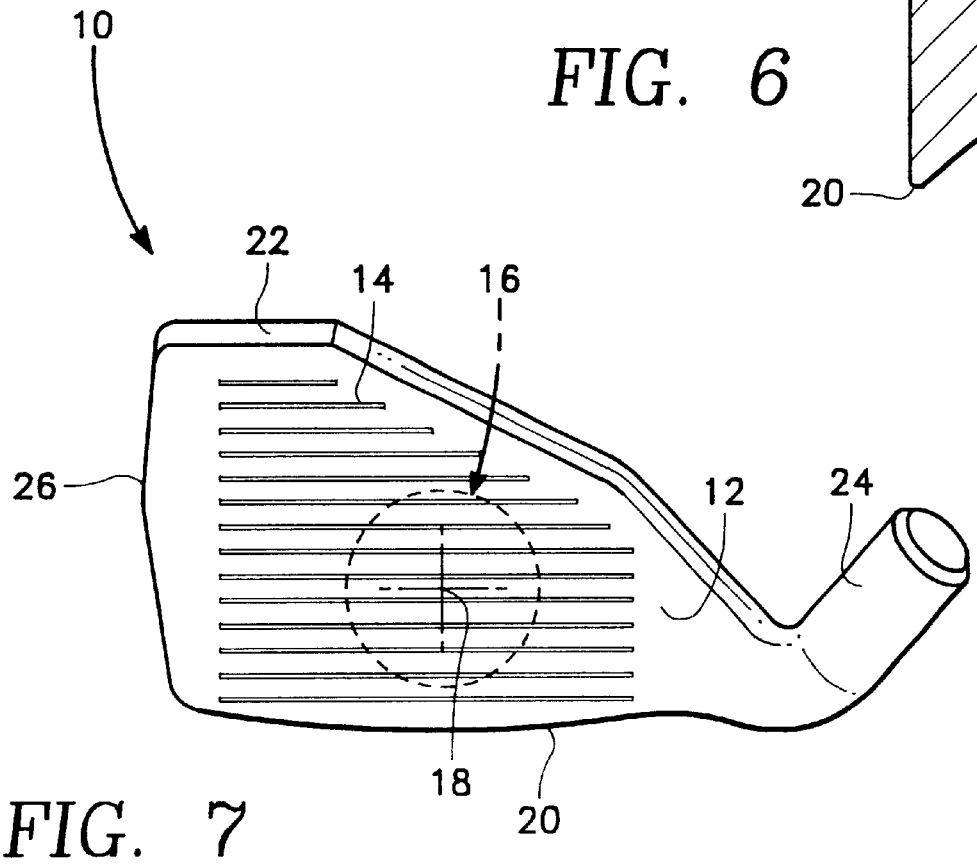
FIG. 7 is a front view of the golf sand wedge head of the present invention with the front face of the head being shown square.

As previously mentioned in FIG. 2, angle D, the first acute angle, is preferably around sixty degrees. Also preferably angle A should be somewhere in the area of around sixty-two degrees. Angle B, the second acute angle, should preferably be around fifty-seven degrees and angle C should preferably be around forty-five degrees. However, the fifty-seven degree angle can be varied to anywhere between fifty to sixty degrees. Also, the forty-five degree angle could be varied anywhere between forty to sixty degrees. The wedge of the present invention will allow a golfer to "work the ball" even out of bunkers that have wet sand. If you are a beginner, high or low handicap amateur or professional, each of these golfers will experience greater ease in getting a ball out of a bunker and hopefully onto the green with the first swing. The swing that is utilized with the wedge head 10 of the present invention is precisely the same swing that is used for all the other clubs in the golfer's bag. In the past, this has generally not been true with the sand wedge as the sand wedge swing has been taught to be different than the other swings. It is believed to be a better situation to have precisely the same swing for each golf club in the golfer's bag as the golfer will then tend to become more consistent by establishing repeatability in conjunction with the swing and the flight of the golf ball to the precise location. It is to be understood that a conventional golf club shaft 42 is to be connected to the hosel 24.

What is claimed is:

1. A golf sand wedge head comprising:

a hosel adapted to have fixedly thereto a golf club shaft, said hosel having a longitudinal center axis, said hosel being physically connected to a body;

said body having a front face for striking a golf ball in a central section of said front face and a rear face which is opposite said front face, said body being displaced from said longitudinal center axis not intersecting such, said front face having a toe edge located furthest from said hosel, said front face having a bottom edge which connects with a planar bottom surface which extends to said rear face, said front face having a top edge located furthest from said bottom edge, said bottom surface being located at a first acute angle relative to said front face, said front face being located at a second acute angle relative to said longitudinal center axis, said bottom edge being offset to be spaced rearwardly a certain distance from said longitudinal center axis; and said rear face including only three in number of relief areas defined as a first relief area and a second relief area and a third relief area, said first relief area being located directly adjacent said hosel, said second relief area connecting with said toe edge, said third relief area connecting with said top edge, said third relief area extending across both said first relief area and said second relief area and being of a length approximately equal to the combined length of said first relief area and said second relief area, a ridge extending vertically from said sole toward said top edge and extending between said first relief area and said second relief area, whereby the weight of said body is positioned so as to produce a sweet spot which is substantially in alignment with said ridge and located within said central section of said front face.

2. The golf sand wedge head as defined in claim 1 wherein:

said front face being planar.

3. The golf sand wedge head as defined in claim 1 wherein:

said first acute angle being approximately sixty degrees.

4. The golf sand wedge head as defined in claim 1 wherein:

said certain distance being approximately 0.19 inch.

5. The golf sand wedge head as defined in claim 1 wherein:

said second acute angle being approximately fifty-seven degrees.

6. The golf sand wedge head as defined in claim 1 wherein:

said first relief area being the deepest of said relief areas.

7. The golf sand wedge head as defined in claim 1 wherein:

said second relief area being the shallowest of said relief areas.

8. The golf sand wedge head as defined in claim 7 wherein:

said first relief area being the deepest of said relief areas.

9. The golf sand wedge head as defined in claim 8 wherein:

said front face being planar.

10. The golf sand wedge head as defined in claim 9 wherein:

said first acute angle being approximately sixty degrees.

11. The golf sand wedge head as defined in claim 10 wherein:

said certain distance being approximately 0.19 inches.

12. The golf sand wedge head as defined in claim 11 wherein:

said second acute angle being approximately fifty-seven degrees.

* * * * *